United States Patent [19]

Lin

[11] Patent Number: 5,041,814

[45] Date of Patent: Aug. 20, 1991

[54] LOCK WITH ALARM DEVICE

[76] Inventor: Fu-Tong E. Lin, Hu Lin Street, Taipei, Taiwan

[21] Appl. No.: 540,785

[22] Filed: Jun. 20, 1990

[51] Int. Cl.[5] ..... E05B 45/06; H01H 27/06

[52] U.S. Cl. ..... 340/542; 70/438; 200/61.66; 340/521

[58] Field of Search ..... 340/542, 521, 528; 200/61.19, 61.64, 61.66, 61.78; 70/438, 439, 441, DIG. 49, 134

[56] References Cited

U.S. PATENT DOCUMENTS

| | | | |
|---|---|---|---|
| 3,587,080 | 6/1971 | Hawkins | 340/542 |
| 3,810,145 | 5/1974 | Gusaras | 70/DIG. 49 X |
| 3,986,376 | 10/1976 | Lack | 70/DIG. 49 x |
| 4,186,578 | 2/1980 | Sommer | 70/441 X |
| 4,370,644 | 1/1983 | Droz | 340/528 |
| 4,803,460 | 2/1989 | Rhee et al. | 340/542 X |

*Primary Examiner*—Glen R. Swann, III

*Assistant Examiner*—Thomas J. Mullen, Jr.

*Attorney, Agent, or Firm*—Bacon & Thomas

[57] ABSTRACT

A door lock is provided with three alarm switches for activating an alarm system. The first switch has a first pair of contacts which are formed by a spring urging a tumbler pin and a metallic sleeve in which the spring is inserted. The second switch has a second pair of contacts which are urged toward each other and disposed on two opposite sides of a tongue connected to a tumbler for oeprating a lock bolt. The third switch has a third pair of contacts operable by a slide bar slidably disposed along the lock bolt. When an attempt is made to pick the lock, the first switch is closed to activate the alarm system; when an attempt is made to pull the lock cylinder out of the door, the second switch is closed to activate the alarm system; and when an attempt is made to pry open the door, the third switch is closed to activate the alarm system.

2 Claims, 3 Drawing Sheets

LOCK WITH ALARM DEVICE

BACKGROUND OF THE INVENTION

The present invention relates to a door lock, and more particularly to one with an alarm switch.

Conventionally, door locks are used for keeping a door locked. However, most conventional door locks are still vulnerable to such physical assaults by burglars or thieves as picking, dismantling, and prying. A burglar or thief attempting to enter a room through a locked entrance usually intends that his assault be unnoticed and quickly done. He would be discouraged from trying to break into the room if an early alarm signal were produced when the door lock was being assaulted. So far, conventional door locks are not provided with any means for producing such an alarm signal.

Therefore, it is the main object of the present invention to provide a door lock with an alarm switch, which is capable of activating an alarm system when the door lock is being picked, dismantled, or pried.

SUMMARY OF THE INVENTION

The door lock with an alarm switch of the present invention includes a lock assembly provided with three switch means which are capable of activating an alarm system when the door lock is picked, dismantled or pried. The lock assembly has a lock cylinder of pin-tumbler type, which is provided with a plurality of pins operatively associated with a tumbler, a tongue connected to the tumbler, and a lock bolt operable by the tongue. The three switch means include a first pair of contact points formed by a spring urging one of the pins and a metallic sleeve, a second pair of contact points disposed on two opposite sides of the tongue, and a third pair of contact points operable by a slide bar extending along the lock bolt. When the door lock is picked, the first pair of contact points is caused to close and the alarm system is activated. When the lock cylinder is dismantled or pulled out of the door, the second pair of contact points is caused to close and the alarm system is activated. When the door lock is pried, the third pair of contact points is caused to close and the alarm system is activated.

The present invention can best be understood through the following description with reference to the accompanying drawings:

DETAILED DESCRIPTION OF THE PREFERRED EMBODIMENT

Figure 1:
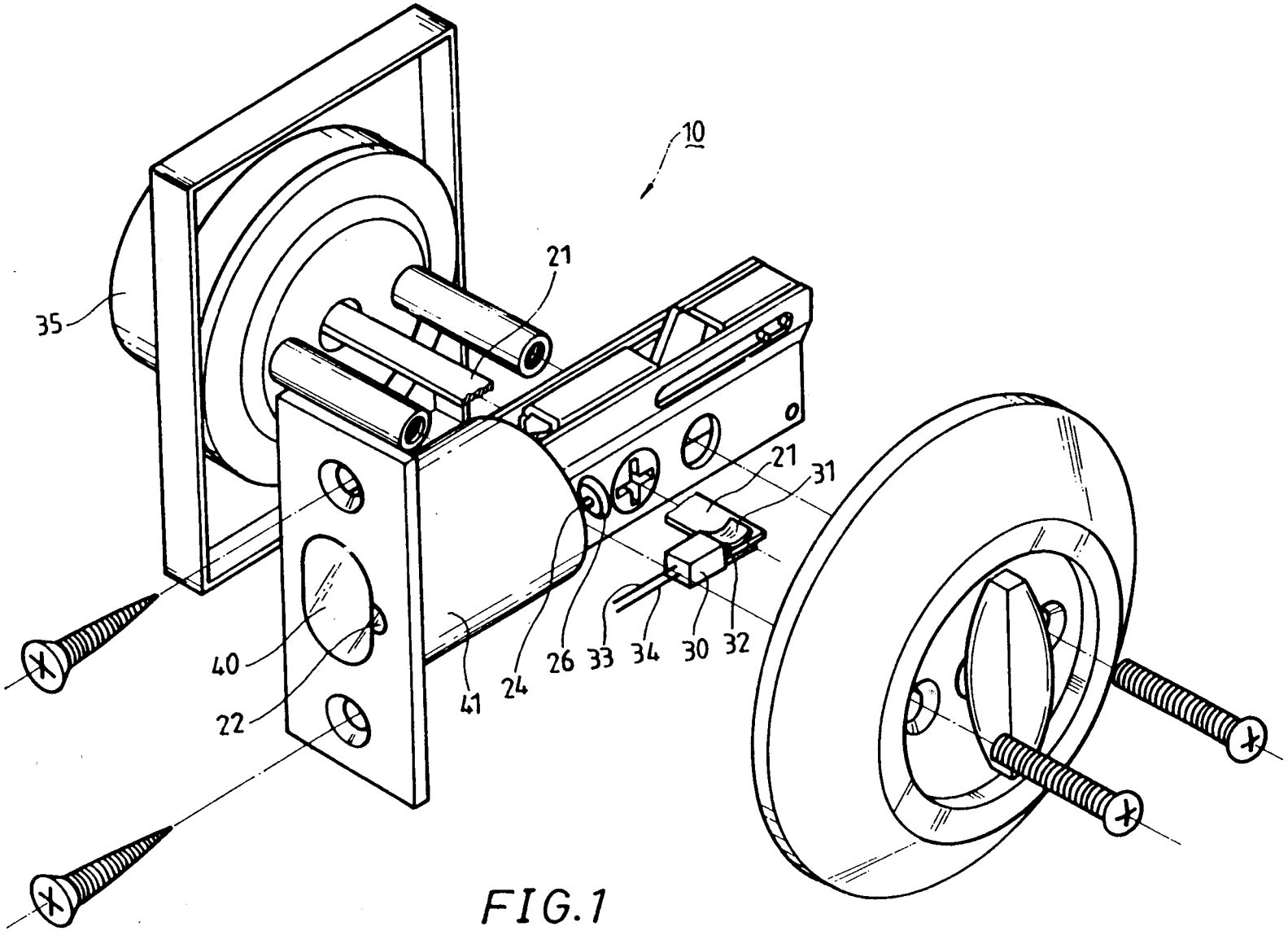
FIG. 1 is a perspective, exploded view of the door lock with an alarm device of this invention, with the tongue partially in section.

Referring now to FIGS. 1–5, the door lock with an alarm device of this invention includes a lock assembly 10 and three switch means 20, 30, and 50. Lock assembly 10 includes a lock cylinder 35 in which a tumbler 36 is rotatably inserted, and a lock bolt 40 operatively connected with tongue 21 connected to tumbler 36.

Figure 2:
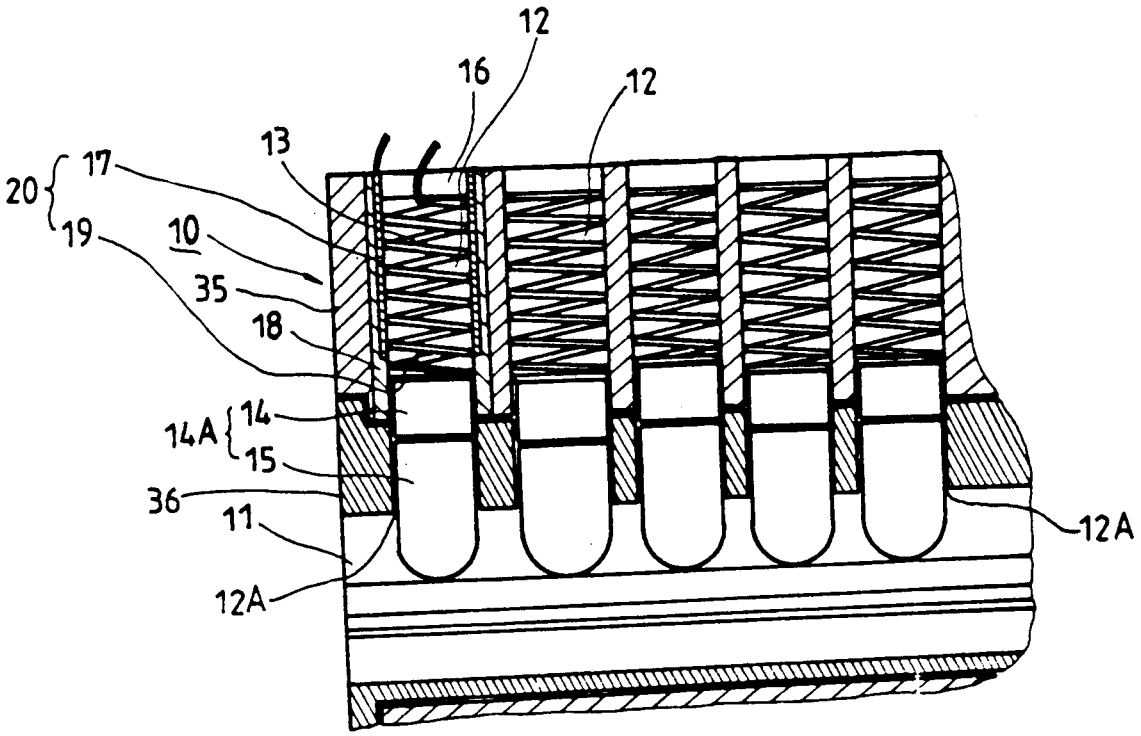
FIG. 2 is a fragmentary sectional view of the lock cylinder of the lock according to the present invention.
Figure 3:
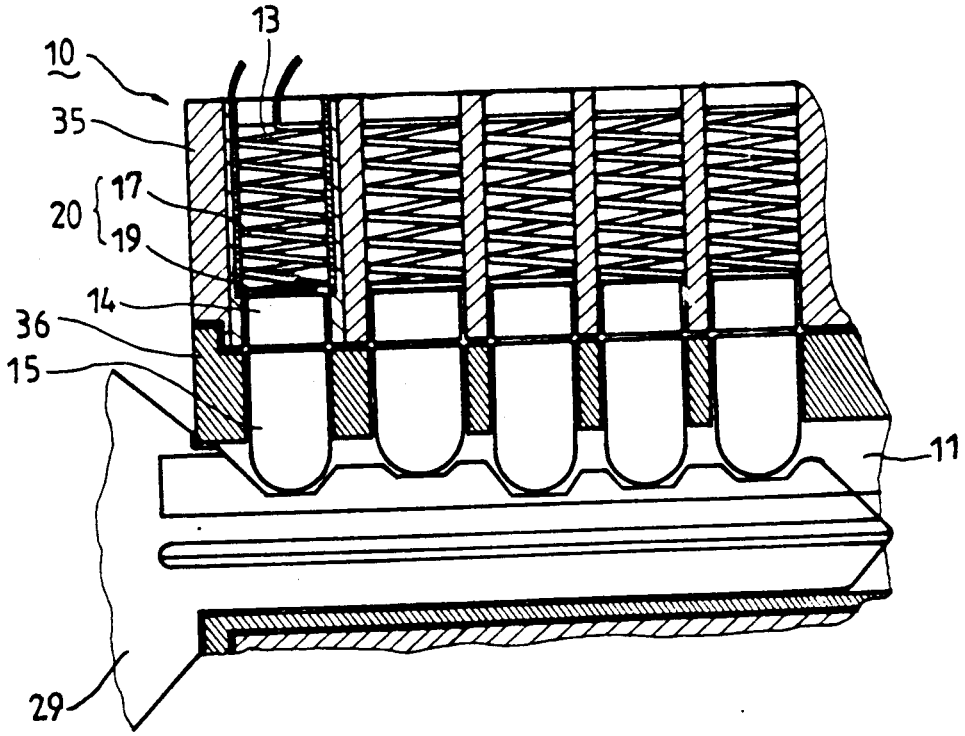
FIG. 3 is a fragmentary sectional view of the lock cylinder of FIG. 1, with a matching key being inserted.

Lock cylinder 35 is provided with a plurality of holes 12 in each of which a pair of pins 14A is slidably inserted; each pair of pins 14A, consisting of an upper piece 14 and a lower piece 15, is urged by a spring 13. Tumbler 36 is also provided with a plurality of holes 12A to correspond with holes 12 of lock cylinder 35 to slidably receive pairs of pins 14A. The length of the lower piece 15 of each pair of pins 14A varies from one another to form a lock combination, as shown in FIG. 2. When an appropriately shaped key 29 is inserted into a key hole 11 of tumbler 36, lower pieces 15 of pairs of pins 14A are arranged to cause the upper edge of each lower piece 15 to be flush with the periphery of tumbler 36, as shown in FIG. 3, to unlock the lock.

As shown in FIG. 2, one of holes 12 (hereinafter referred to as first hole) in lock cylinder 35 is provided with an outer, cylindrical insulating sleeve 18, and an inner, metallic sleeve 17 which is electrically conductive. Spring (hereinafter referred to as first spring) which is a coil spring loosely fitted in metallic sleeve 17, is made of electrically conductive material and covered with an insulating material, except that the lower end 19 of first spring 13, which normally extends beyond the lower end of metallic sleeve 17, is bare and slightly enlarged to provide an electrical contact point in relation with the lower end of metallic sleeve 17 as an opposite electrical contact point so as to form a first switch means 20; the upper end of first spring 13 is stopped by an insulated plug 16. Lower end 19 of first spring 13 has an outside diameter slightly larger than the other part of first spring 13 so as to assure a good frictional contact between lower end 19 of first spring 13 and the inner surface of the lower end of metallic sleeve 17 when lower end 19 of first spring 13 is pressed by pins 14A to move upward and slidably fit into the lower end of metallic sleeve 17. When the lock is in a locked condition (FIG. 2) the lower end 19 of first spring 13 extends beyond the lower end of metallic sleeve 17. When the lock is unlocked by inserting an appropriately shaped key 19 into the key hole 11 (FIG. 3), first spring 13 is compressed and the lower end 19 of first spring 13 is caused to come into contact with the lower end of metallic sleeve 17. The upper end of first spring 13 is electrically connected by a cable to an alarm system (not shown), and the upper end of metallic sleeve 17 is also electrically connected to the same alarm system. When key 29 is inserted into keyhole 11, as shown in FIG. 2, lower piece 15 and upper piece pin 14 are upwardly urged to compress first spring 13 so that lower end 19 comes in contact with metallic sleeve 17 thus closing, first switch means 20 and activating the alarm system. The alarm system can be provided with a time delay device so that it operates only when the person using key 29, or a picking tool, fails to successfully unlock lock 10 within 5 or 10 seconds, or designed to gradually increase its loudness over. say 10 seconds. Thus, the locking function provided by lock 10 is assured since a thief, if he could not successfully unlock a lock within a short time, would pull out the picking tool in order to quiet the alarm device.

Figure 4:
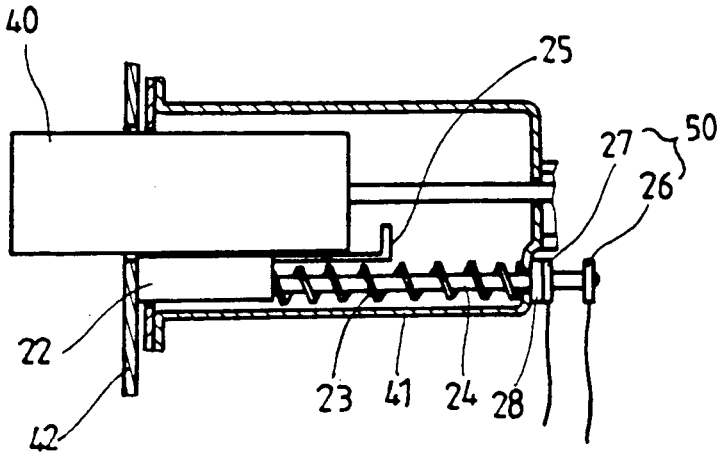
FIG. 4 is a schematic drawing showing the arrangement of the lock bolt and the third pair of contact points in an open condition.
Figure 5:
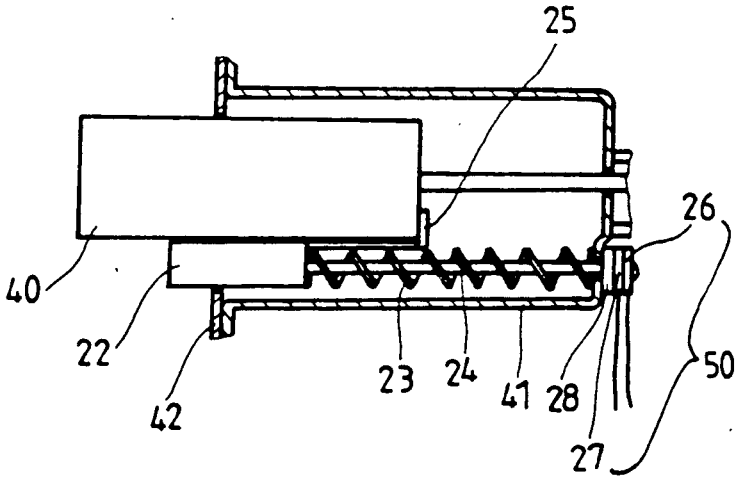
FIG. 5 is a schematic drawing showing the arrangement of the lock bolt and the third pair of contact points in a closed condition.

As shown in FIG. 1, second switch means 30 is provided with two metallic pieces 31, 32, to form a second pair of electrical contact points. The two metallic pieces 31, 32 are formed so as to produce a force force urging themselves toward each other, with tongue 21, which is coated with an insulating material, interposed between the two metallic pieces 31, 32. Second switch means 30 is so mounted within the lock that when tongue 21 rotates, second switch means 30 (and metallic pieces 31, 32) rotates with tongue 21; however, when tongue 21 is caused to move longitudinally, second switch means 30 will not move with tongue 21. Second switch means 30 is electrically connected to an alarm system (not shown). In normal conditions, the two metallic pieces 31, 32 are separated by tongue 21. When tongue 21 is pulled out from between metallic pieces 31, 32 as lock cylinder 35 is removed from the lock, the two metallic pieces 31, 32 are caused to come into contact with each other, thus closing the second switch means 30 and activating the alarm system As shown in FIGS. 4 and 5, third switch means 50 has a slide bar 22 arranged to slide along lock bolt 40, a movable contact point 26 connected with slide bar 22 by rod 24 extending from slide bar 22, a fixed contact point 27 fixedly mounted onto a housing 41 of lock bolt 40 to correspond with movable contact point 27, a spring 23 adapted to urge slide bar 22 in such a manner as to urge movable contact point 26 towards fixed contact 27. A hook 25 is provided on slide bar 22 to be operable by lock bolt 40 so that when lock bolt 40 is retracted (unlocked), slide bar 22 is moved inwardly and movable contact point 26 is moved away from fixed contact point 27. Slide bar 22 is so arranged that when the door is closed, slide bar 22 is kept from moving outwardly by a strike plate 42 (FIG. 4) of the entrance. When the lock is pried to create a gap between the door edge and the strike plate 42 as when a burglar attempts to clear the lock bolt 40 from the strike plate 42, slide bar 22 is allowed to move outwardly by the force of spring 23, and movable contact 26 is moved to come into contact with fixed contact 27, thus closing, third switch means 50 and activating the alarm system.

Movable contact 26 and fixed contact 27 are respectively electrically connected to an alarm system, (not shown). When they come in contact with each other, the alarm system is activated.

What is claimed is:

1. A door lock for locking a door, comprising a lock cylinder having a tumbler rotatably inserted in said lock cylinder, a pair of pins slidably inserted in a hole formed in said lock cylinder and said tumbler, a spring urging said pair of pins towards a key hole formed in said tumbler, a tongue connected to operate a lock bolt to extend to lock the door, said pair of pins including an upper piece and a lower piece, said lower piece extending into said key hole;

a first switch means defined by said lower piece of said pair of pins being caused to move away from said key hole;

a second switch means defined by said tongue being caused to move in a longitudinal direction; and a third switch means defined by said door being separated from a jamb of the door while said lock bolt is extended.

2. The door lock as recited in claim 1, wherein said spring is made of an electrically conductive material and includes a lower end, and said first switch means includes a first pair of contacts formed by said lower end of said spring and a metallic sleeve in which said lower end of said spring is inserted, said first pair of contacts being separated when said lower piece of said pair of pins extends freely into said key hole, and being caused to close when said lower piece of said pair of pins is caused to move against said spring;

said second switch means includes a second pair of contacts having said tongue interposed between said second pair of contacts; and said third switch means includes a third pair of contacts operable by a slide bar slidably disposed along said lock bolt.

* * * * *